United States Patent [19]

Even et al.

[11] Patent Number: 4,585,168

[45] Date of Patent: Apr. 29, 1986

[54] HIGH PRESSURE LIQUID INSTALLATION

[75] Inventors: Hans-Dieter Even, Duisburg; Bodo Missmahl, Duesseldorf; Karl-Heinz Redmers, Moers; Hubertus Rembe, Krefeld, all of Fed. Rep. of Germany

[73] Assignee: WOMA Apparatebau, Duisburg, Fed. Rep. of Germany

[21] Appl. No.: 599,545

[22] Filed: Apr. 12, 1984

[30] Foreign Application Priority Data

Apr. 13, 1983 [DE] Fed. Rep. of Germany ..... 3313249

[51] Int. Cl.[4] ..... B67D 5/38; B05B 9/03; B05B 7/02

[52] U.S. Cl. ..... 239/74; 239/127; 239/527; 239/569; 137/115

[58] Field of Search ..... 239/71, 74, 124, 126, 239/127, 526, 527, 569; 137/115, 116.3, 495; 417/317

[56] References Cited

U.S. PATENT DOCUMENTS

| | | | |
|---|---|---|---|
| 3,140,049 | 7/1964 | Norstrud et al. | 239/126 |
| 3,147,767 | 9/1964 | Goss | 239/127 X |
| 3,298,386 | 1/1967 | Douglas | 137/115 |
| 3,626,968 | 12/1971 | Hancock | 137/115 |
| 3,690,558 | 9/1972 | Tuttle | 239/127 |
| 3,760,982 | 9/1973 | Haase | 239/126 X |
| 3,885,739 | 5/1975 | Tuttle | 239/124 |
| 4,216,911 | 8/1980 | Huperz et al. | 239/526 |
| 4,279,268 | 7/1981 | Aubert | 137/115 |
| 4,349,154 | 9/1982 | Pacht | 239/124 |

*Primary Examiner*—Andres Kashnikow
*Assistant Examiner*—Mary Beth O. Jones
*Attorney, Agent, or Firm*—McCormick, Paulding & Huber

[57] ABSTRACT

The invention relates to a high-pressure liquid installation with a pressurized water generator (10) to which a spraying device (42) is connected, while an adjustable pressure-limiting valve (14) is arranged between the pressurized water generator (10) and the spraying device (42). The pressure-limiting valve (14) is adjustable in its pressure by remote operation by electrical signals which can be generated by electrical control elements (56, 58), while a delay device (40) may be provided for surge-free pressure adjustment.

14 Claims, 2 Drawing Figures

HIGH PRESSURE LIQUID INSTALLATION

The invention relates to a high-pressure liquid installation according to the pre-characterising clause of claim 1.

Such an installation is known from German Utility Model No. 74 01,818, which describes a cleaning appliance which operates with liquid or steam and exhibits a gunlike discharging device for the liquid or the steam. In this case, in order to prevent the back surge which occurs when the on/off switch valve which is provided in the discharging device is closed, a valve has to be operated which blocks the feed of liquid to the discharging device and directs the liquid back to the pump. This additional valve may be operated by an electrical switch from the discharging device.

However, high-pressure water jet cleaning installations which are provided with a spray gun or with a rotary nozzle beam frequently demand considerable physical efforts of the operator during service at maximum pressure, so that operation at maximum pressure should be performed only for short periods. On the other hand, maximum pressure is frequently also only necessary in the case of very heavy adhesions of dirt or similar. The operator should therefore be enabled to operate also with a medium pressure, but to change briefly to maximum pressure and finally be able to perform a rinsing off and rinsing away of the dirt particles with a minimum pressure stage, particularly as this would also involve a considerable economy of energy and a reduced consumption of water.

It is therefore the object of the invention to develop a high-pressure liquid installation according to the pre-characterising clause of claim 1, which provides the operator with a convenient possibility of adjustment of the operating pressure.

This object is achieved when the remote-operated valve is constructed as an adjustable pressure-limiting valve and is adjustable in its pressure by remote operation from electrical control elements arranged on the spraying device or in its region, whilst a delay device for a surge-free pressure adjustment is optionally associated with the pressure-limiting valve. By this means a convenient possibility of pressure adjustment is created which can be performed on the spraying device, and which permits an advantageous mode of operation at different pressures with corresponding economy of energy and of water. The delay device serves in this case as a safety measure in order to eliminate pressure surges which might be dangerous particularly when changing over to maximum pressure, and also in order to ensure a long service life.

The pressure-limiting valve, which may particularly be constructed as an overflow valve, may be adjustable pneumatically, by electric motor or hydraulically, whilst the adjusting force influences particularly a (mechanical or pneumatic) spring device of this valve.

For many applications, a relatively small number (for example three) of preadjustable pressure stages are sufficient, selection between which can be made by actuating the control elements. However, a substantially continuous pressure adjustment may also be effected, possibly by means of a stepping motor, which is actuated by a corresponding electrical control element.

A throttle is suitable as a delay device, for example in the case of pneumatic or hydraulic adjustment of the pressure-limiting valve, whereas in the case of electric motor adjustment, a regulator should possibly be used in order to obtain a surge-free pressure adjustment.

As a spraying device, a spray gun, a nozzle beam or similar, for example, such as are used for example for cleaning ship's walls or similar by removal, may be used.

Further developments of the invention may be seen from the following description and from the subordinate claims.

The invention is explained more fully below with reference to the exemplary embodiment illustrated in the accompanying drawings.

Figure 1:
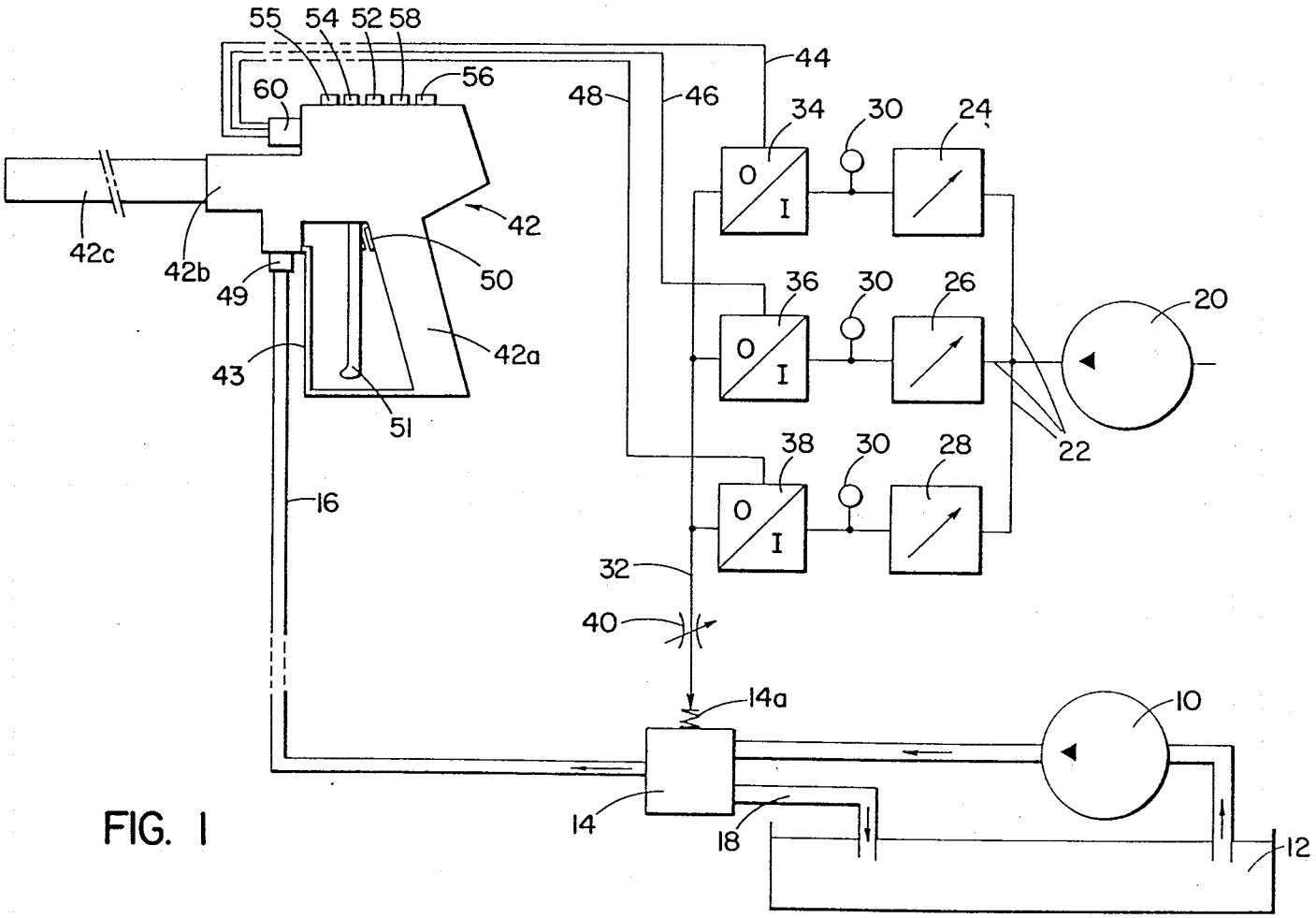
FIG. 1 shows diagrammatically an installation with a pneumatic control device.

A high-pressure pump 10 delivers water from a tank 12 to a pressure-limiting valve 14 constructed as an overflow valve, which also serves as a safety valve in this case. The water, under maximum pump pressure, which is delivered by the high-pressure pump 10, is divided by the pressure-limiting valve 14 into two branch streams, the first of which is fed as operating medium to a high-pressure hose 16, whereas the second flows back through a return pipe 18 into the tank 12. This is controlled by a pneumatically modulable spring 14*a* of the pressure-limiting valve 14, whilst the pneumatic pressure influences the hydraulic operating medium pressure in conformity with a prescribed function; a linear association exists in the simplest case.

In order to generate the pneumatic control pressure, an air compressor 20 delivers air into a pipe 22, which leads to three (in the exemplary embodiment illustrated) reducing valves 24, 26 and 28. A manometer 30 is associated with each reducing valve 24, 26, 28. The reducing valves 24, 26, 28 are each connected on the outlet side to the inlet of a solenoid switching valve 34, 36 or 38. The arrangement is made here so that only one of the switching valves 34, 36 or 38 can be moved into the open position at any one time. The outlets of all the switching valves 34, 36, 38 are combined in a pipe 32 and lead through a time delay restriction as throttle element 40 to the pneumatic control inlet of the pressure-limiting valve 14.

A pipe 44, 46 or 48, which is associated with each switching valve, permits the switching valves 34, 36, 38 to be actuated by means of control impulses. The pipes 44, 46, 48 are connected to control elements of a spray gun 42. (The signal transmission may optionally also be effected wirelessly).

Figure 2:
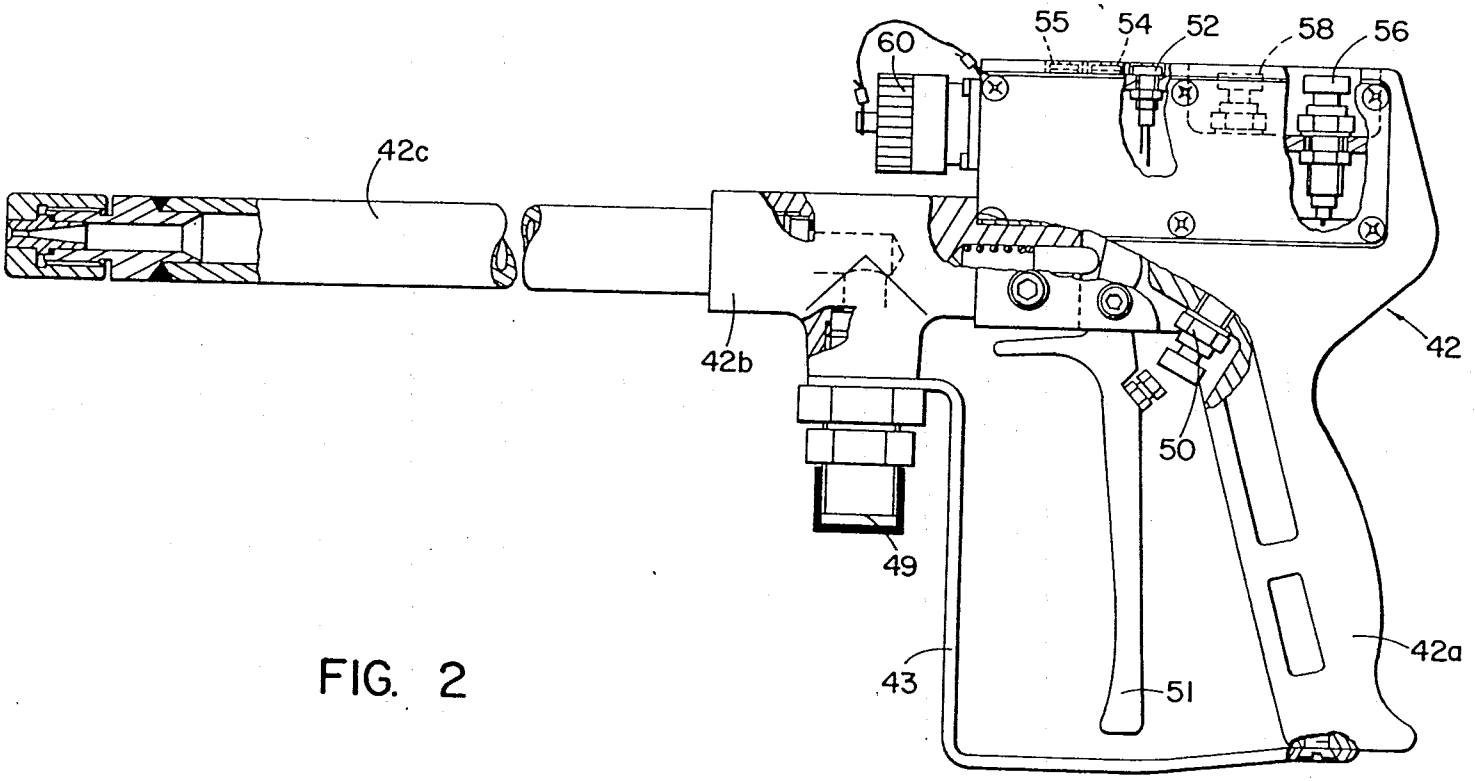
FIG. 2 shows, partly in section, a spraying device in the form of a gun for the installation of FIG. 1.

FIG. 2 shows a gun 42 serving as spraying device with a handle 42*a* and with a connecting spigot 42*b* for a nozzle tube 42*c*, with a high-pressure liquid connection 49 for the high-pressure hose 16 and with a trigger lever 51 for the tripping switch 50. The trigger lever 51 is surrounded by a guard and support loop 43. The gun 42 further comprises a connecting means 60 for the electrical voltage and for a connecting cable to the light-emitting diodes 52, 54, 55 and to the control elements 56, 58 constructed as switches and to the tripping switch 50 in the interior of the gun housing.

The tripping switch 50, which is actuated by the trigger lever 51, serves to release the pressurised medium. It releases the pressurised medium only when the control element 56 has been depressed once and readiness for service has therefore been indicated by the lighting-up of the diode 52. Depending upon how many times the control element 58, which is a push-button with a control mechanism comprising three steps, is depressed, one of the three pressure stages provided becomes operative by the control element 58 influencing the switching valves 34, 36, 38. This is simultaneously indicated by the lighting-up of one or two light-emitting diodes 54, 55 associated with each pressure stage.

A signal from the pump control meaning that the high-pressure pump is running, is a necessary condition for operation of the gun 42. When the gun 42 is ready for service, a pulse can be given to a following flip-flop relay (not shown) by actuating the control element 56, constructed as a push-button, on the gun 42, so that all the functions of the gun 42 are activated Switching off is likewise effected by a pulse to be initiated at the control element 56.

The service state of the activated pistol 42 is indicated by the lit-up light-emitting diode 52 (red for example). The lowest pressure stage is selected in parallel with the first command to the control element 56. This is indicated by the lighting-up of the light-emitting diode 54 (yellow for example). When a higher pressure stage is required, the control mechanism of the control element 58, which comprises three steps, must be stepped onwards in conformity with the required pressure stage by giving a brief command to the control element 58 with the trigger lever 51 simultaneously released, and therefore with the tripping switch 50 switched off. The pressure stage selected is indicated by the lighting-up of the light-emitting diodes 54, 55, lowest pressure stage light-emitting diode 54, medium pressure stage light-emitting diode 55 and highest pressure stage light-emitting diodes 54, 55 together. Now, by actuating the trigger lever 51 and therefore the tripping switch 50, the high-pressure water can be switched on or switched off in conformity with the preselected pressure stage and therefore sprayed and/or returned to the suction side of the high-pressure pump 10. It is not possible to change the pressure stages whilst the trigger lever 51 is actuated.

In order to put the installation out of service, the trigger lever 51 is released and the control element 56 is then actuated, so that the light-emitting diode 52 extinguishes and the gun 42 is now secured against accidental switching on of the high-pressure water.

The transition from one operating pressure to the next occurs smoothly, because the adjustable throttle element 40 permits the changes of the pneumatic control pressure at the overflow valve 14 to take effect only gradually.

It is to be understood that the customary safety valves, non-return valves et cetera are provided, although these have not been included in the drawing here for reasons of clarity.

We claim:

1. High-pressure liquid installation with a pressurized liquid generator to which a spraying device is connected, a valve between the pressurized liquid generator and the spraying devce which can be opened and closed by remote operation by a switch in order to feed the liquid to the spraying device or return the same to the region of the suction side of the pressurized liquid generator, said valve being constructed as an adjustable pressure-limiting valve and adjustable in its pressure by remote operation, electrical control elements arranged in association with the spraying device and operable to adjust said pressure limiting valve, a delay device for surge-free pressure adjustment associated with the valve, and said pressure limiting valve having at least two pressure stages which are selectable by actuation of said control elements and preadjustable in conformity with required pressure levels, and a control device for preadjusting said required pressure levels.

2. Installation according to claim 1, characterised in that the pressure-limiting valve (14) is loaded by a spring force which is adjustable by a control device (20 to 38).

3. Installation according to claim 1, characterised in that the pressure adjustment can be performed in conformity with a prescribed, particularly linear, function between the pressure and the force acting on the pressure-limiting valve (14).

4. Installation according to claim 1, characterised in that an additional tripping switch (50) is wired in series with the electrical control elements (56, 58) as a two-handed safety device.

5. Installation according to claim 1, characterised in that the pressure stages are obtainable with time delay.

6. Installation according to claim 1, characterised in that the delay device is a throttle (40).

7. Installation according to claim 2, characterised in that an air compressor (20) with a pneumatic control block (22 to 40) is provided as control device, whilst said block exhibits parallel-connected reducing valves (24, 26, 28) to prescribe pressure stages and each reducing valve (24, 26, 28) is followed by a switching valve (34, 36, 38) which can be actuated by an associated switch on the spraying device (42).

8. Installation according to claim 1, characterised in that an optical display means (52, 54, 55) is provided on the spraying device (42).

9. Installation according to claim 8, characterised in that the display means consists of light-emitting diodes (52, 54, 55).

10. Installation according to claim 9, characterised in that a low pressure stage can be switched on by means of a control element (56) of the spraying device (42), serving also as main switch, and a control element (58) constructed as a switch with associated light-emitting diodes (54, 55) is allocated to each of the higher pressure stages.

11. Installation according to claim 10, characterised in that the switching valves (36, 38) following the control element (58) for the higher pressure stages can be moved into the "off" position by switching off the control element (56).

12. Installation according to claim 1, characterised in that a switch (58) employed as control element exhibits as a push-button a plurality of control positions, by each of which a switching valve (34, 36, 38) of another pressure stage can be actuated.

13. Installation according to claim 1, characterized in that the spraying device (42) exhibits a trigger (51) and a tripping switch (50), actuated thereby whilst the restoration of the trigger (51) into its rest position maintains a preselected pressure stage.

14. Installation according to claim 1, characterized in that a triggering switch is provided and the control elements (56, 58) are locked against actuation in the "on" position thereby.

* * * * *